US007959326B2

(12) United States Patent
Laporte

(10) Patent No.: US 7,959,326 B2
(45) **Date of Patent: *Jun. 14, 2011**

(54) ORIENTABLE LENS FOR A LED FIXTURE

(75) Inventor: Jean-Francois Laporte, Boisbriand (CA)

(73) Assignee: Philips Electronics Ltd, Markham, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/832,358

(22) Filed: Jul. 8, 2010

(65) Prior Publication Data

US 2010/0271829 A1 Oct. 28, 2010

Related U.S. Application Data

(63) Continuation of application No. 12/171,362, filed on Jul. 11, 2008, now Pat. No. 7,766,509.

(60) Provisional application No. 61/061,392, filed on Jun. 13, 2008.

(51) Int. Cl.
*F21S 4/00* (2006.01)
*F21V 21/00* (2006.01)

(52) U.S. Cl. ..... 362/249.02; 362/249.03; 362/283; 362/311.02; 362/323; 362/327; 362/800

(58) Field of Classification Search ..... 362/249.01–249.04, 277, 282–283, 311.02, 322–323, 362/327, 800

See application file for complete search history.

(56) References Cited

U.S. PATENT DOCUMENTS

| | | | |
|---|---|---|---|
| 2,908,197 | A | 10/1959 | Well et al. |
| 3,596,136 | A | 7/1971 | Fischer |
| 3,711,722 | A | 1/1973 | Kavanagh |
| 3,774,021 | A | 11/1973 | Johnson |
| 4,161,770 | A | 7/1979 | Maurer |
| 4,698,730 | A | 10/1987 | Sakai et al. |
| 4,860,177 | A | 8/1989 | Simms |
| 4,941,072 | A | 7/1990 | Yasumoto et al. |
| 5,130,897 | A | 7/1992 | Kuzma |
| 5,140,220 | A | 8/1992 | Hasegawa |
| 5,335,157 | A | 8/1994 | Lyons |
| 5,481,440 | A | 1/1996 | Oldham et al. |
| 5,485,317 | A | 1/1996 | Perissinotto et al. |
| 5,608,290 | A | 3/1997 | Hutchisson et al. |
| 5,636,057 | A | 6/1997 | Dick et al. |
| 5,924,788 | A | 7/1999 | Parkyn, Jr. |
| 6,045,240 | A | 4/2000 | Hochstein |
| 6,050,707 | A | 4/2000 | Kondo et al. |
| 6,177,761 | B1 | 1/2001 | Pelka et al. |
| 6,227,685 | B1 | 5/2001 | McDermott |
| 6,273,596 | B1 | 8/2001 | Parkyn, Jr. |
| 6,296,376 | B1 | 10/2001 | Kondo et al. |

(Continued)

FOREIGN PATENT DOCUMENTS

| | | | |
|---|---|---|---|
| JP | 11154766 | A | 6/1999 |

(Continued)

*Primary Examiner* — Jason Moon Han

(74) *Attorney, Agent, or Firm* — John F. Salazar; Mark L. Beloborodov

(57) ABSTRACT

A mounting surface for mounting a plurality of LEDs has a plurality of orientable lenses each individually affixed about a single LED. Each orientable lens may have a primary reflector and a refracting lens that direct light emitted from a single LED to a reflective surface of the orientable lens that reflects the light off a primary LED light output axis.

21 Claims, 14 Drawing Sheets

U.S. PATENT DOCUMENTS 6,361,191 B1 3/2002 Simon
6,450,661 B1 9/2002 Okumura
6,560,038 B1 5/2003 Parkyn, Jr. et al.
6,598,998 B2 7/2003 West et al.
6,607,286 B2 8/2003 West et al.
6,623,150 B2 9/2003 Roller et al.
6,679,621 B2 1/2004 West et al.
6,784,357 B1 8/2004 Wang
6,837,605 B2 1/2005 Reill
6,850,001 B2 2/2005 Takekuma
6,942,361 B1 9/2005 Kishimura et al.
6,948,838 B2 9/2005 Kunstler
6,951,415 B2 10/2005 Amano et al.
6,965,715 B2 11/2005 Lei et al.
6,986,593 B2 1/2006 Rhoads et al.
6,997,580 B2 2/2006 Wong
7,006,306 B2 2/2006 Falicoff et al.
7,009,213 B2 3/2006 Camras et al.
7,021,801 B2 4/2006 Mohacsi
7,034,343 B1 4/2006 Kim et al.
7,040,767 B2 5/2006 Lee et al.
7,083,313 B2 8/2006 Smith
7,090,389 B2 8/2006 Parker et al.
7,104,672 B2 9/2006 Zhang
7,111,964 B2 9/2006 Suehiro et al.
7,118,262 B2 10/2006 Negley
7,142,769 B2 11/2006 Hsieh et al.
7,144,121 B2 12/2006 Minano et al.
7,153,000 B2 12/2006 Park et al.
7,153,002 B2 12/2006 Kim et al.
7,172,319 B2 2/2007 Holder et al.
7,172,324 B2 2/2007 Wu et al.
7,181,378 B2 2/2007 Benitez et al.
7,276,737 B2 10/2007 Camras et al.
7,281,816 B2 10/2007 Suzuki
7,281,833 B2 10/2007 Akiyama
7,322,718 B2 1/2008 Setomoto et al.
7,334,918 B2 2/2008 Newton et al.
7,339,200 B2 3/2008 Amano et al.
7,339,202 B2 3/2008 Chiu et al.
7,348,723 B2 3/2008 Yamaguchi et al.
7,387,405 B2 6/2008 Ducharme et al.
7,390,109 B2 6/2008 Li et al.
7,431,492 B2 10/2008 Ohkawa
7,454,119 B2 11/2008 Hsieh et al.
7,458,703 B2 12/2008 Han et al.
7,473,014 B2 1/2009 Katoh et al.
7,549,769 B2 6/2009 Kim et al.
7,572,036 B2 8/2009 Yoon et al.
7,582,913 B2 9/2009 Huang et al.
7,602,559 B2 10/2009 Jang et al.
7,618,160 B2 11/2009 Chinniah et al.
7,618,163 B2 11/2009 Wilcox
7,637,630 B2 12/2009 Wilcox et al.
7,674,018 B2 3/2010 Holder et al.
7,688,526 B2 3/2010 Lu et al.
2004/0037076 A1 2/2004 Katoh et al.
2004/0105264 A1 6/2004 Spero
2004/0228127 A1 11/2004 Squicciarini
2005/0265029 A1 12/2005 Epstein et al.
2006/0181866 A1 8/2006 Jung et al.
2006/0250803 A1 11/2006 Chen
2006/0255353 A1 11/2006 Taskar et al.
2006/0285311 A1 12/2006 Chang et al.
2007/0019429 A1* 1/2007 Gasquet ..... 362/510
2007/0066310 A1 3/2007 Haar et al.
2007/0081340 A1 4/2007 Chung et al.
2007/0091615 A1 4/2007 Hsieh et al.
2007/0183736 A1 8/2007 Pozdnyakov et al.
2007/0253080 A1 11/2007 Yokote et al.
2008/0013322 A1 1/2008 Ohkawa
2008/0100773 A1 5/2008 Hwang et al.
2008/0204888 A1 8/2008 Kan et al.
2008/0273327 A1 11/2008 Wilcox et al.

FOREIGN PATENT DOCUMENTS

WO 03044870 A1 5/2003
WO 2005093316 A1 10/2005
WO 2007100837 A2 9/2007

* cited by examiner

ORIENTABLE LENS FOR A LED FIXTURE

CROSS-REFERENCE TO RELATED APPLICATIONS

This application is a continuation of currently pending U.S. patent application Ser. No. 12/327,432, filed Dec. 3, 2008 and entitled "Orientable Lens for a LED Fixture," which is a continuation-in-part of currently pending U.S. patent application Ser. No. 12/171,362, filed Jul. 11, 2008 and entitled "Orientable Lens for a LED Fixture," which claims benefit from and priority to U.S. Provisional Application Ser. No. 61/061,392, filed Jun. 13, 2008, entitled "Orientable Lens for a LED Fixture." The instant application claims the benefit of all the listed applications, which are hereby incorporated by reference in their entireties.

BACKGROUND

1. Field of the Invention

The present invention is related generally to a lens placeable about an LED, and more specifically to a lens placeable about an LED and configured to direct light output from the LED in an off-axis direction.

2. Description of Related Art

Light emitting diodes, or LEDs, have been used in conjunction with various lenses that reflect light emitted by the LED. Also, various lenses have been provided for use in light fixtures utilizing a plurality of LEDs as a light source.

DETAILED DESCRIPTION

Figure 1:
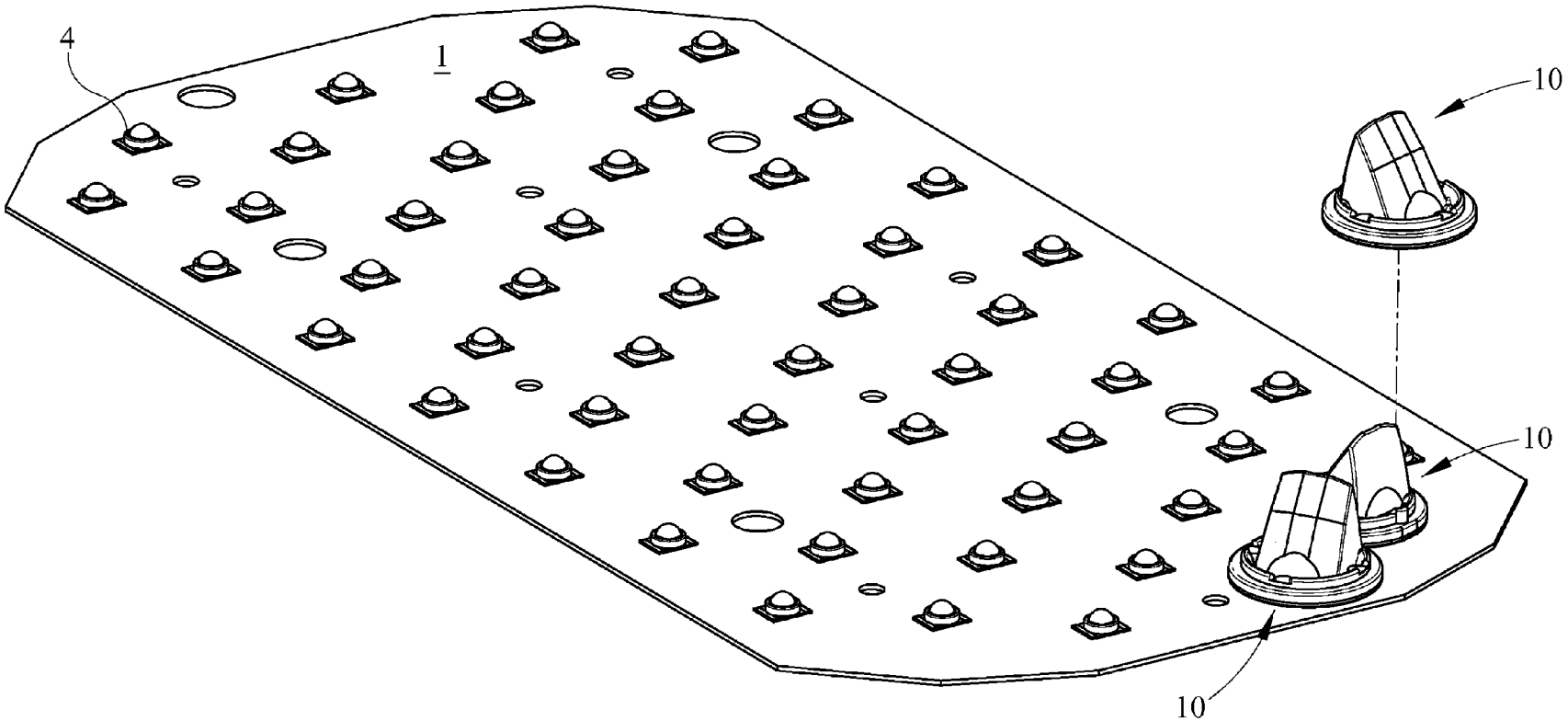
FIG. 1 is a top perspective view of a LED fixture with orientable lens wherein a flat board is populated with a plurality of LEDs and shown with three orientable lenses, two of which are affixed to the flat board about respective LEDs and one of which is shown exploded away from its respective LED.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical configurations illustrated in the drawings are intended to exemplify embodiments of the invention and that other alternative mechanical configurations are possible.

Referring now in detail to FIGS. 1-10, wherein like numerals indicate like elements throughout the several views, there are shown various aspects of an orientable lens for a LED fixture. Orientable lens is usable in conjunction with a single LED and may be installed and used with a variety of LEDs. Orientable lens is preferably used as a lens for a LED with a Lambertian light distribution although it may be configured for and used as a lens for LEDs having other light distributions as well. FIG. 1 shows a LED flat board 1, on which is mounted fifty-four LEDs 4 with a Lambertian light distribution. In some embodiments of LED flat board 1, LED flat board 1 is a metallic board with advantageous heat distribution properties such as, but not limited to, aluminum. In other embodiments LED flat board 1 is a flame retardant 4 (FR-4) or other common printed circuit board. LED flat board 1 and plurality of LEDs 4 are merely exemplary of the multitude of boards, number of LEDs, and multitude of LED configurations in which a plurality of orientable lenses for a LED may be used. Design considerations such as, but not limited to, heat, desired lumen output, and desired light distribution pattern may result in a choice of differing amounts of LEDs, differing LED configurations, and/or differing materials.

Also shown in FIG. 1 are three of one embodiment of orientable lens 10, two of which are shown placed over respective LEDs 4 and mated to flat board 1 and one of which is shown exploded away from its respective LED 4. Being orientable means that each lens is individually adjustable to a given orientation about a given LED. As will become clear, when a plurality of orientable lenses 10 are used in conjunction with a plurality of LEDs, each orientable lens 10 may be individually oriented without regard to the orientation of other orientable lenses 10, such as, for example, the three orientable lenses 10 of FIG. 1 which are each oriented in a unique direction. Moreover, when a plurality of LEDs are present, as few as one LED, or as many as all LEDs in some preferred embodiments, may be provided with an individual orientable lens 10. Some or all lenses may be individually and permanently adjusted to a given orientation upon creation of the LED fixture with an orientable lens or some or all lenses may be attached to allow for adjustment in the field. Thus, complex photometric distribution patterns and a flexibility of distribution patterns may be achieved when using a plurality of orientable lenses 10 with a plurality of LEDs, such as, but not limited to, plurality of LEDs 4 on flat board 1.

Figure 2:
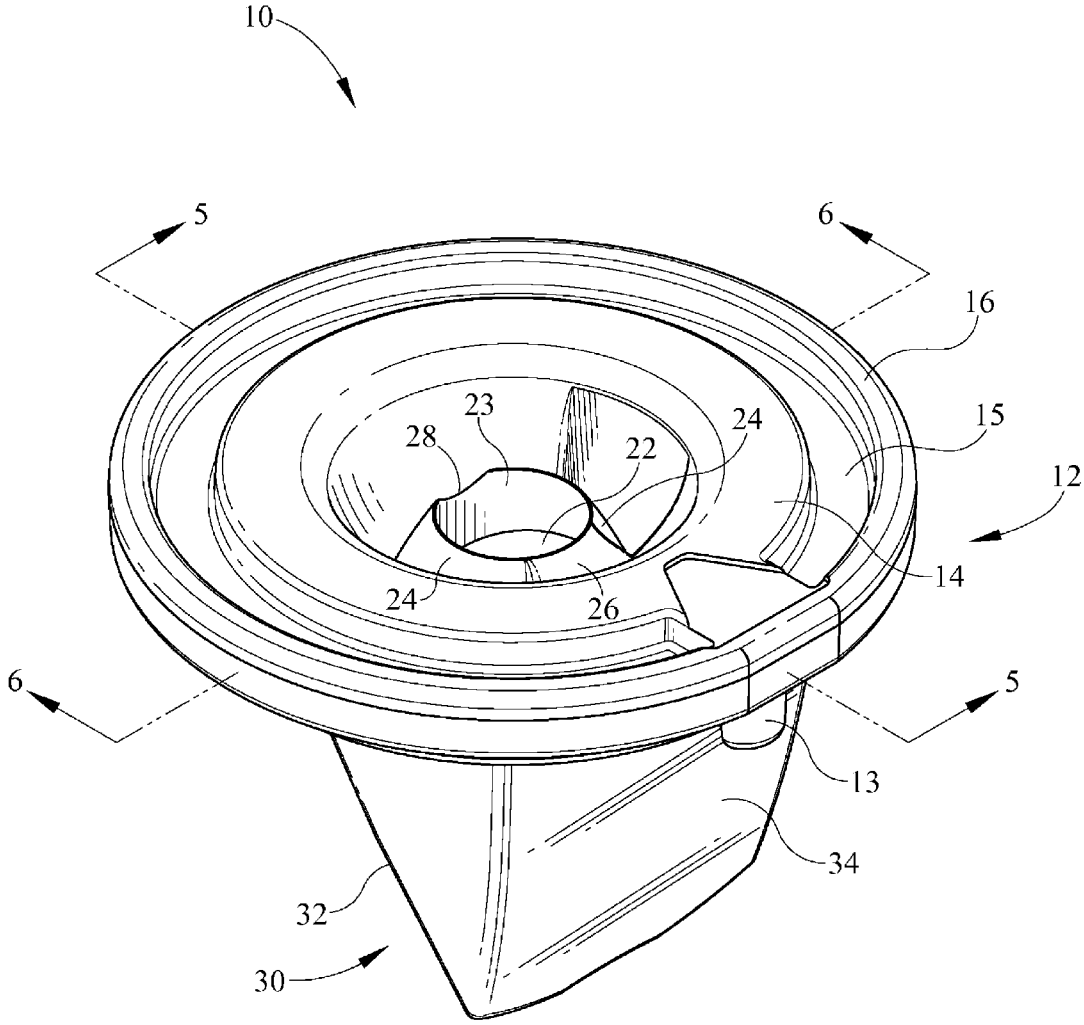
FIG. 2 is a top perspective view of one of the orientable lenses of FIG. 1.
Figure 3:
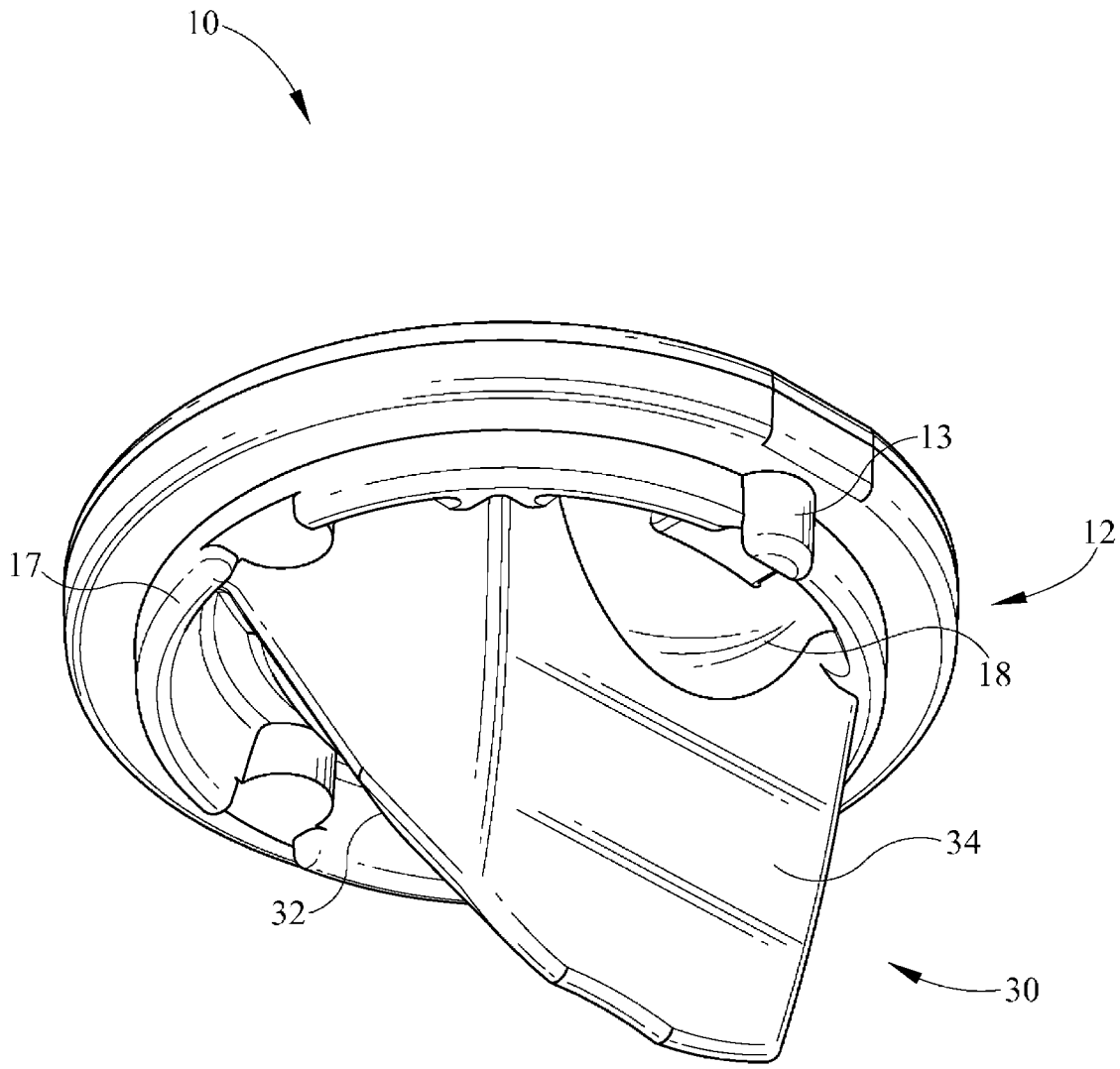
FIG. 3 is a bottom perspective view of the orientable lens of FIG. 2.
Figure 4A:
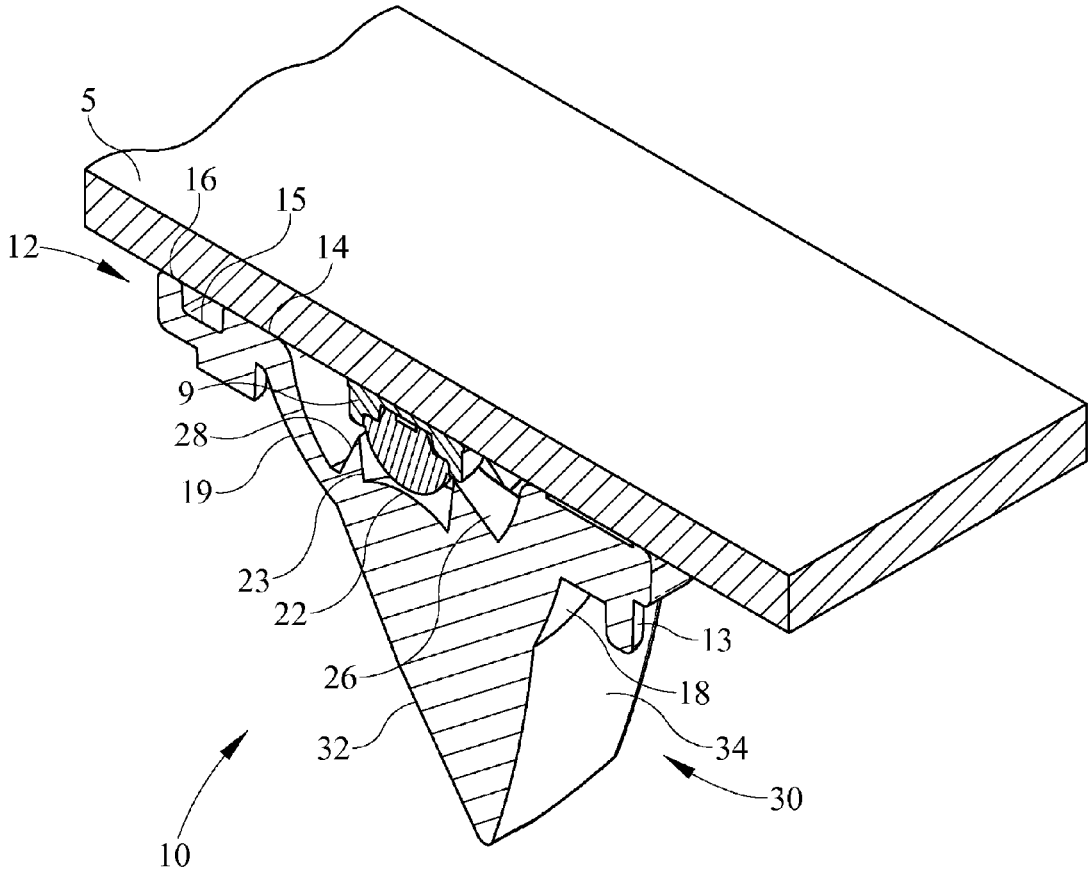
FIG. 4A is a top perspective view of the orientable lens of FIG. 2 taken along the line 5-5, and a sectioned view of a LED attached to a mounting surface, with the orientable lens affixed to the mounting surface about the LED.
Figure 4B:
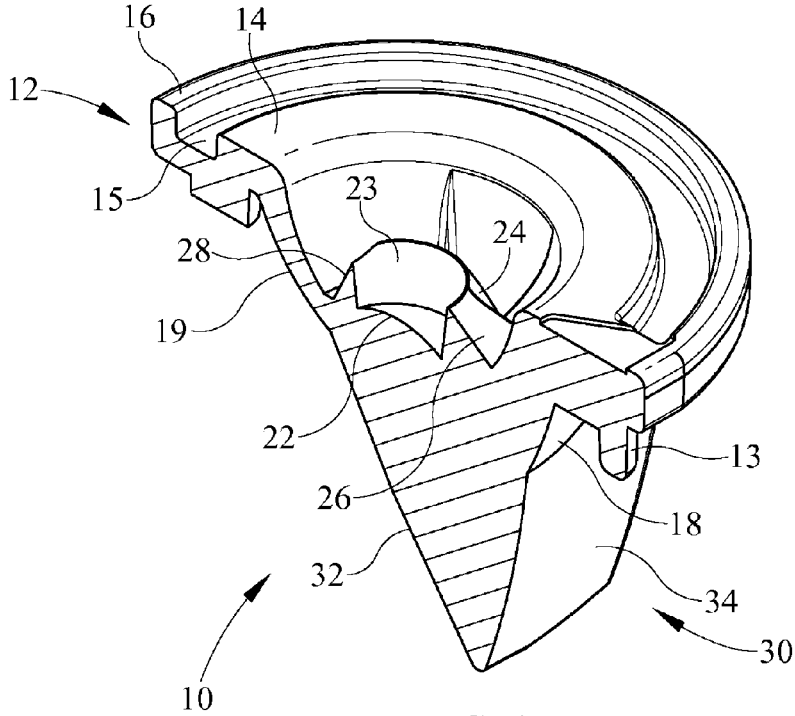
FIG. 4B is a top perspective view of the orientable lens of FIG. 2 taken along the line 5-5.

Turning now to FIG. 2 and FIG. 3, an embodiment of orientable lens 10 is shown in more detail. Orientable lens 10 has a base 12 that is shown in this embodiment as having a substantially flat and substantially circular inner and outer mating surface 14 and 16, each with substantially circular inner and outer peripheries. Base 12 of FIG. 2 is also shown with a recessed portion 15 provided in between a substantial portion of inner and outer mating surfaces 14 and 16. Base 12 is provided, among other things, for attachment of orientable lens 10 to a surface on which a LED is mounted, such as, for example, attachment to flat board 1 of FIG. 1. Attachment of base 12 to a surface on which a LED is mounted and not to a LED itself reduces heat transfer from a LED to orientable lens 10. In some embodiments both inner and outer mating surface 14 and 16 mate with a surface for attachment of orientable lens 10. In some embodiments only inner mating surface 14 mates with a surface for attachment of orientable lens 10 and outer mating surface 16 interacts with a surface for alignment of orientable lens 10 about an LED. In some embodiments inner and/or outer mating surface 14 and 16 or other provided surface may be adhered to a mounting surface for attachment of orientable lens 10. In some embodiments inner and/or outer mating surface 14 and 16 or other provided surface may be snap fitted with a mounting surface for attachment of orientable lens 10. In some embodiments inner and/or outer mating surface 14 and 16 or other provided surface may be compressed against a mounting surface for attachment of orientable lens 10. Other attachment means of base 12 to a mounting surface may be provided as are generally known to those of ordinary skill in the art and as may be based on the teachings hereof.

Figure 6A:
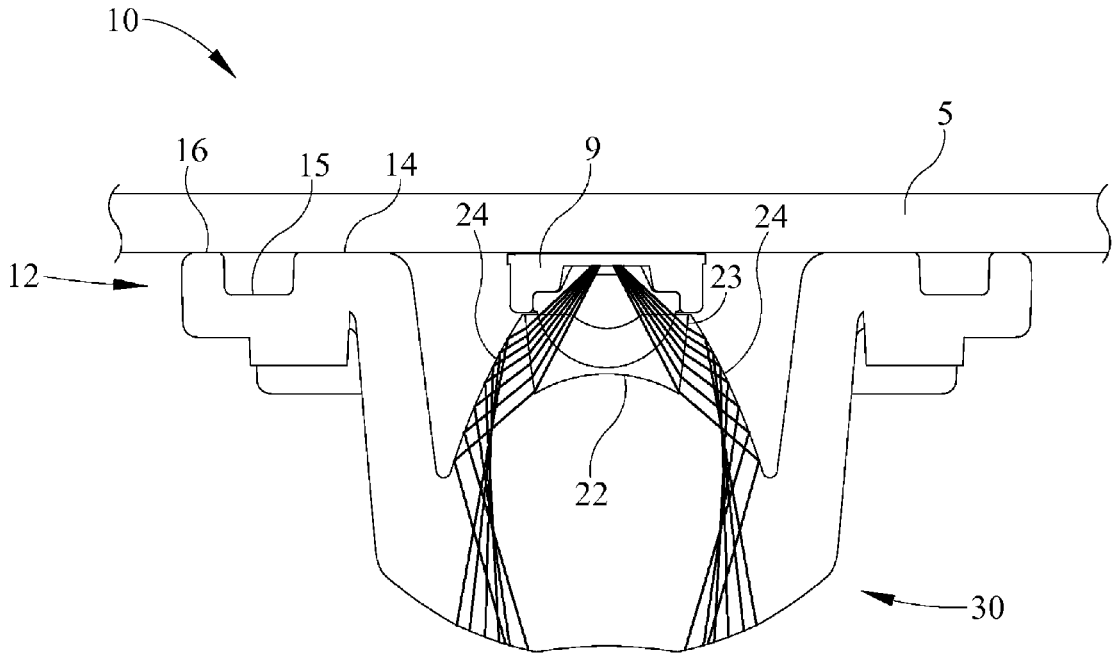
FIG. 6A is a sectional view of the orientable lens of FIG. 2 taken along the line 6-6 and shown with a ray trace of exemplary light rays that emanate from a source and contact portions of a primary reflector.
Figure 6B:
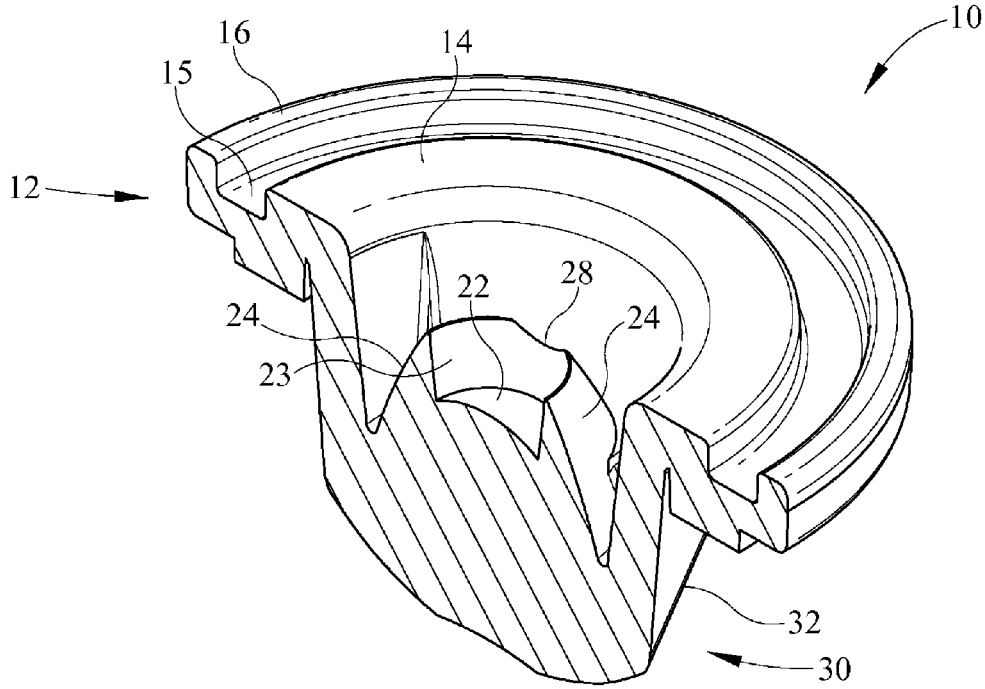
FIG. 6B is a front top perspective view of the orientable lens of FIG. 2 taken along the line 6-6.

Base 12 also has portions that may be provided for aesthetic purposes or support or attachment of other constituent parts of orientable lens 10. For example, in some preferred embodiments, at least primary reflector 24 (as shown in FIG. 6A) and reflecting prism 30 are attached to and supported by base 12. Some embodiments of orientable lens 10 may be provided with a base 12 having supports 18 or 19 that may help provide for support of reflecting prism 30 and may also be provided to fully seal orientable lens 10. Some embodiments of base 12 of orientable lens 10 may also be provided with rim portion 17 and like appendages if desired for ease in installation or other reasons. In some embodiments, when orientable lens is installed about a LED on a mounting surface, a sheet or other object may contact rim portion 17, or other portions of base 12, such as the flange portion provided around rim portion 17 and provide compressive force on orientable lens 10 in the direction of the mounting surface, thereby causing inner and/or outer mating surfaces 14 and 16 to mate with the mounting surface for attachment of orientable lens 10.

In other embodiments base 12 may take on different shapes and forms so long as it enables orientable lens 10 to be appropriately used with a given LED and be installable at any orientation around an LED light output axis, the LED light output axis being an axis emanating from the center of the light emitting portion of any given LED and oriented away from the LED mounting surface. For example, base 12 may be provided in some embodiments without recessed portion 15 and with only one distinct mating surface, as opposed to inner and outer mating surfaces 14 and 16. Also, for example, base 12 may be provided with inner and/or outer peripheries that have a shape other than circular. Also, for example, base 12 may be provided with other configurations for attachment to and/or support of constituent parts of orientable lens 10, such as primary reflector 24 and reflecting prism 30. Other variations on base 12 will be apparent to one skilled in the art.

Also shown in FIG. 2 are portions of a refracting lens 22, primary reflector 24, a surface 26, a reflecting portion 28, and reflecting prism 30. When orientable lens 10 is placed about an LED and base 12 is affixed to a surface, such as LED 9 and surface 5 of FIG. 4A, FIG. 5A, FIG. 5B, and FIG. 6A, refracting lens 22 and primary reflector 24 are proximal LED 9. In particular, primary reflector 24 is positioned such that it partially surrounds the light emitting portion of LED 9 and refracting lens 22 is positioned such that it intersects the LED light output axis of LED 9 and is partially surrounded by primary reflector 24. In some embodiments primary reflector 24 is a parabolic reflector. Refracting lens 22 and primary reflector 24 are positioned so that a majority of light emitted from LED 9 will collectively be incident upon one of the two. In some embodiments, primary reflector 24 may be provided such that it completely surrounds the light emitting portion of LED 9. In some embodiments, such as those shown in the figures, primary reflector 24 only partially surrounds the light emitting portion of LED 9 and reflecting portion 28 is provided on one side of the light emitting portion of LED 9 positioned adjacent primary reflector 24 and surface 26 is provided on a substantially opposite side of the light emitting portion of LED 9 and also positioned adjacent primary reflector 24.

In some additional embodiments refracting lens 22 is positioned at the base of sidewall 23 and sidewall 23 substantially surrounds the light emitting portion of LED 9. A majority of rays emanating from LED 9 and incident upon refracting lens 22 will be refracted such that they are directed towards a reflective surface 32 of reflecting prism 30. In some embodiments, refracting lens 22 is configured such that it refracts rays so they are substantially collimated towards reflective surface 32, such as the exemplary rays shown in FIG. 5A.

In other embodiments, other rays emanating from LED 9 will be incident upon sidewall 23 proximal primary reflector 24, pass therethrough at an altered angle and will be incident upon primary reflector 24. A majority of rays incident upon primary reflector 24 are reflected and directed towards reflective surface 32 of reflecting prism 30, such as the exemplary rays shown in FIG. 6A which are directed towards portions of reflective surface 32 not shown in the figure, but evident from reference to other figures. In some embodiments of orientable lens 10, primary reflector 24 has a composition and orientation such that a majority of rays incident upon it are internally reflected and directed towards reflective surface 32. In other embodiments, primary reflector 24 is composed of a reflective material.

In additional embodiments, other rays emanating from LED 9 will be incident upon sidewall 23 proximal reflecting portion 28, pass therethrough at an altered angle and will be incident upon reflecting portion 28. A majority of rays incident upon reflecting portion 28 are reflected and directed towards reflective surface 32 of reflecting prism 30, such as the exemplary rays shown incident upon reflecting portion 28 and directed towards reflective surface 32 in FIG. 5B. In some embodiments reflecting portion 28 is positioned and configured to direct light rays in a unique direction from those rays directed by primary reflector 24 and refracting lens 22 such that they also exit orientable lens 10 in a unique direction. In embodiments of orientable lens 10 reflecting portion 28 has a composition and orientation such that a majority of rays incident upon it are internally reflected and directed towards reflective surface 32. In other embodiments, reflecting portion 28 is composed of a reflective material.

Figure 5A:
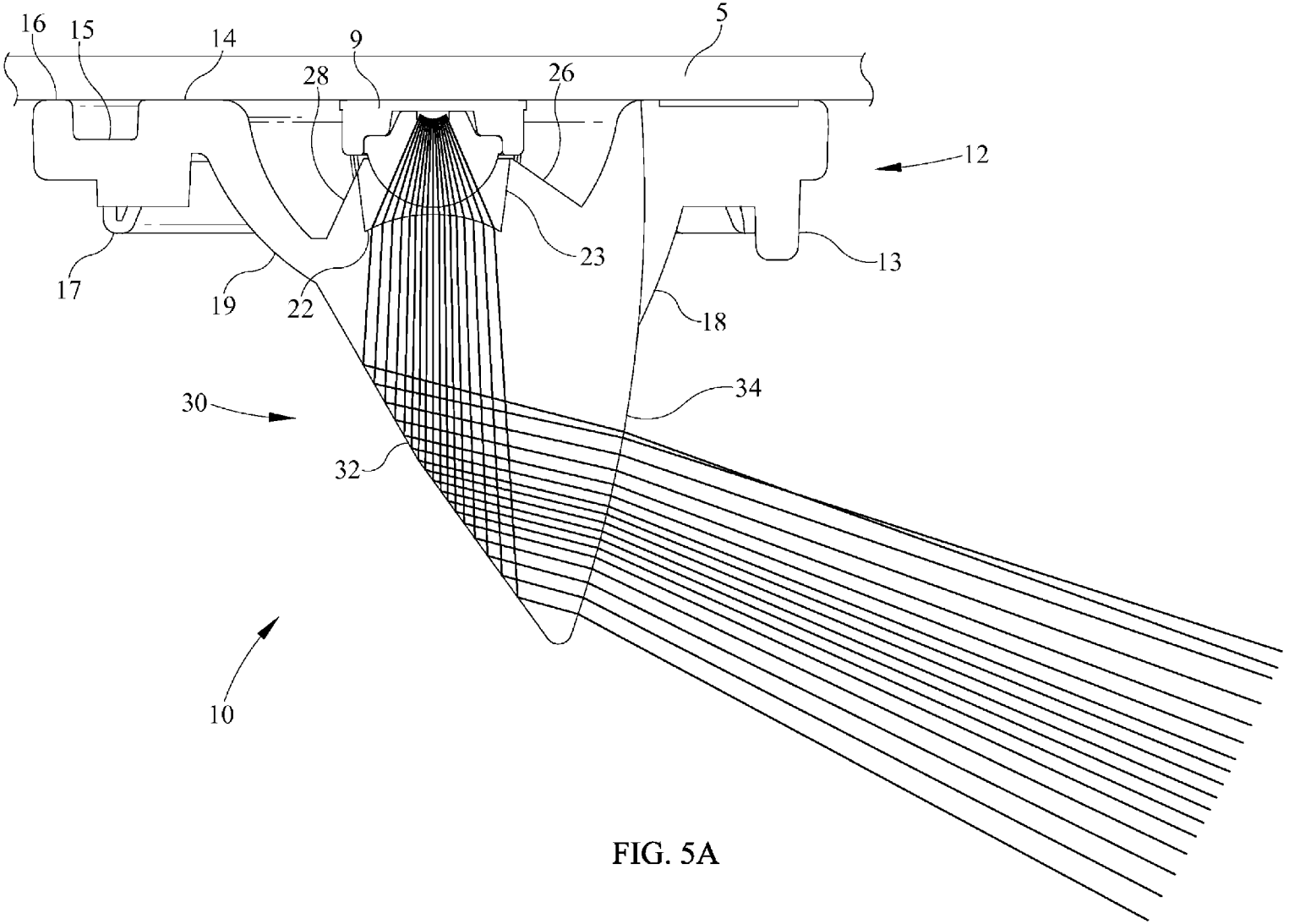
FIG. 5A is a sectional view of the orientable lens of FIG. 2 taken along the line 5-5 and shown about a LED with a ray trace of exemplary light rays that emanate from the LED and contact the refracting lens.
Figure 5B:
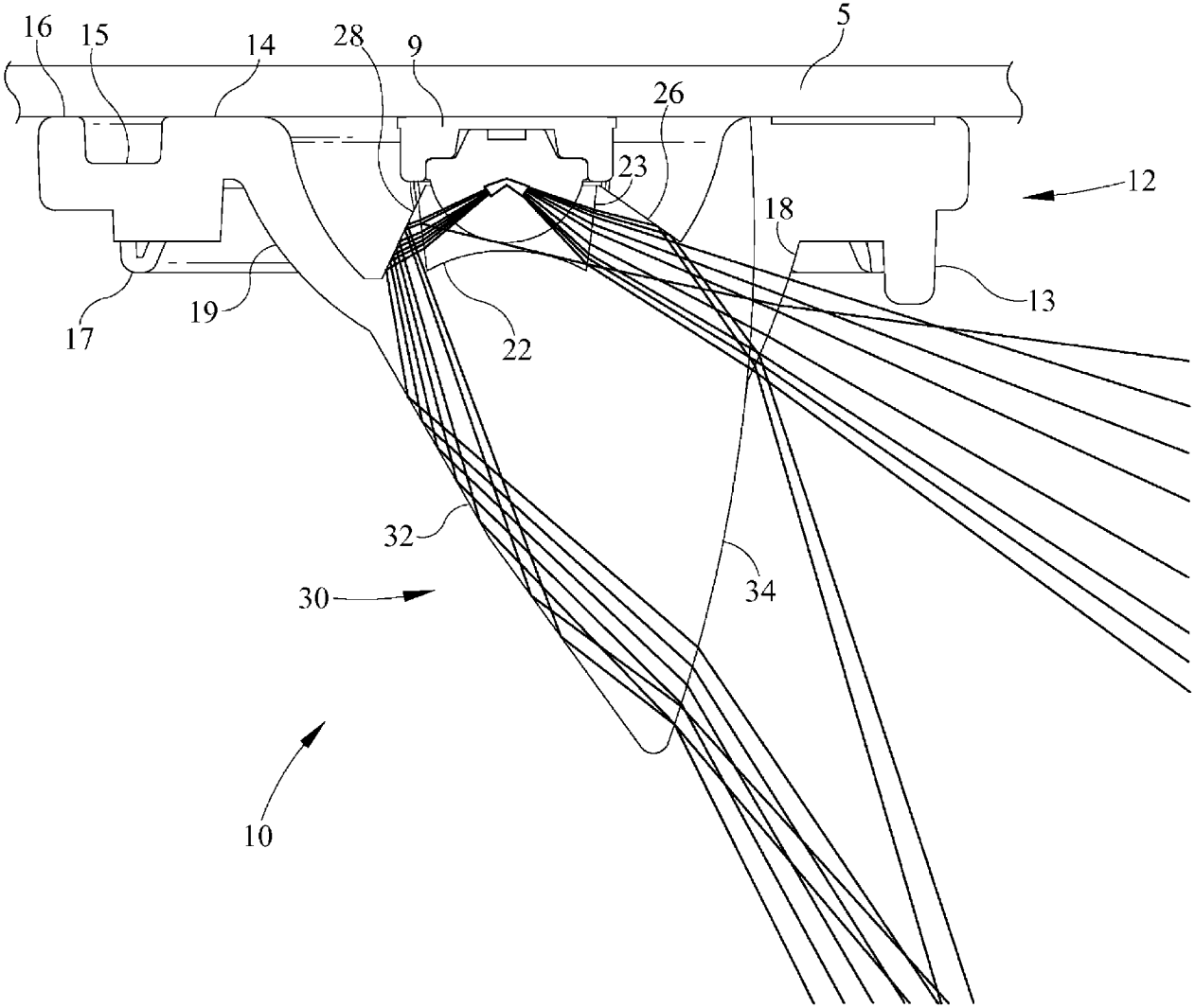
FIG. 5B is a sectional view of the orientable lens of FIG. 2 taken along the line 5-5 and shown about a LED with a ray trace of exemplary light rays that emanate from the LED and pass through a sidewall and either contact a reflecting portion or are directed towards an optical lens.

In some embodiments, other rays emanating from LED 9 will be incident upon sidewall 23 proximal surface 26, pass therethrough at an altered angle and will be directed towards an optical lens 34 of reflecting prism 30, such as the exemplary rays shown in FIG. 5B. A majority of these rays will pass through optical lens 34 and many of the rays will also pass through support 18 as shown in FIG. 5B. Also, as shown in FIG. 5B, some light rays may also be incident upon surface 26 and reflected and directed towards lens 34 and potentially support 18. In the depicted embodiments support 18 allows light rays to pass therethrough and may be configured to refract light rays passing therethrough in a desired direction. One skilled in the art will recognize that varying configurations of orientable lens 10 may call for varying configurations of any or all of refracting lens 22, sidewall 23, primary reflector 24, surface 26, and reflecting portion 28 in order to achieve desired light distribution characteristics.

In some embodiments, sidewall 23 is provided for provision of refracting lens 22 and many rays pass through sidewall 23 prior to being incident upon primary reflector 24 and potentially reflecting portion 28 and surface 26. In some embodiments sidewall 23 alters the travel path of rays passing therethrough. In some embodiments the height of sidewall 23 is shortened near its connection with reflecting portion 28. In other embodiments refracting lens 22 is positioned using thin supports attached to the inner surface of primary reflector 24 or otherwise and sidewall 23 is not provided. Also, in some embodiments, such as shown in the figures, sidewall 23 is provided and orientable lens 10 is formed from an integral molded solid unit of an appropriate medium. In these embodiments where orientable lens 10 forms an integral molded solid unit, once light rays emitted from LED enter orientable lens 10, they travel through the appropriate medium until they exit orientable lens 10. In some embodiments the medium is optical grade acrylic and all reflections occurring within orientable lens 10 are the result of internal reflection.

Reflective surface 32 of reflecting prism 30 may have a composition and orientation such that rays that have been collimated by refracting lens 22 or reflected by primary reflector 24 or reflecting portion 28 and directed towards reflective surface 32 are reflected off reflective surface 32 and directed towards optical lens 34, such as those rays shown in FIGS. 5A and 5B. Preferably the rays are internally reflected off reflective surface 32, although reflective surface 32 could also be formed of a reflective material. Most rays incident upon optical lens 34 pass through optical lens 34, potentially at an altered angle in some embodiments. Preferably, the direction of rays passing through optical lens 34 is only slightly altered. In embodiments where constituent parts of orientable lens 10 form an integral molded solid unit, reflective surface 32 internally reflects any rays incident upon it and rays that emanate from an LED and enter orientable lens 10 travel through the medium of orientable lens 10 until they exit orientable lens 10 through optical lens 34 or otherwise.

Reflective surface 32 of reflecting prism 30 need not be a flat surface. In some embodiments, such as those shown in the figures, reflective surface 32 actually comprises two faces at slightly different angles in order to allow more accurate control of light reflected from reflective surface 32 and to allow for a narrower range of light rays to be emitted by orientable lens 10. In other embodiments a reflective surface may be provided that is curved, concave, convex, or provided with more than two faces. Similarly, optical lens 34 may take on varying embodiments to allow more accurate control of light reflected from reflective surface 32 and/or to allow for a narrower range of light rays to be emitted by orientable lens 10.

Through use of orientable lens 10, the light emitted from a given LED is able to be redirected from the LED light output axis at angle from the LED light output axis. Since orientable lens 10 is installable at any orientation around an LED light output axis, this light can likewise be distributed at any orientation around an LED light output axis. Dependent on the configuration of a given orientable lens 10 and its constituent parts, the angle at which light emitted from an LED is redirected off its light output axis can vary. Moreover, the spread of the light beam that is redirected can likewise vary. When a plurality of orientable lenses 10 are used on a plurality of LEDS mounted on a surface, such as flat board 1 and plurality of LEDs 4, each orientable lens 10 can be installed at any given orientation around an LED axis without complicating the mounting surface. Moreover, complex photometric distribution patterns and a flexibility of light distributions can be achieved with a plurality of LEDs mounted on a surface, such as flat board 1 and plurality of LEDs 4.

Figure 7:
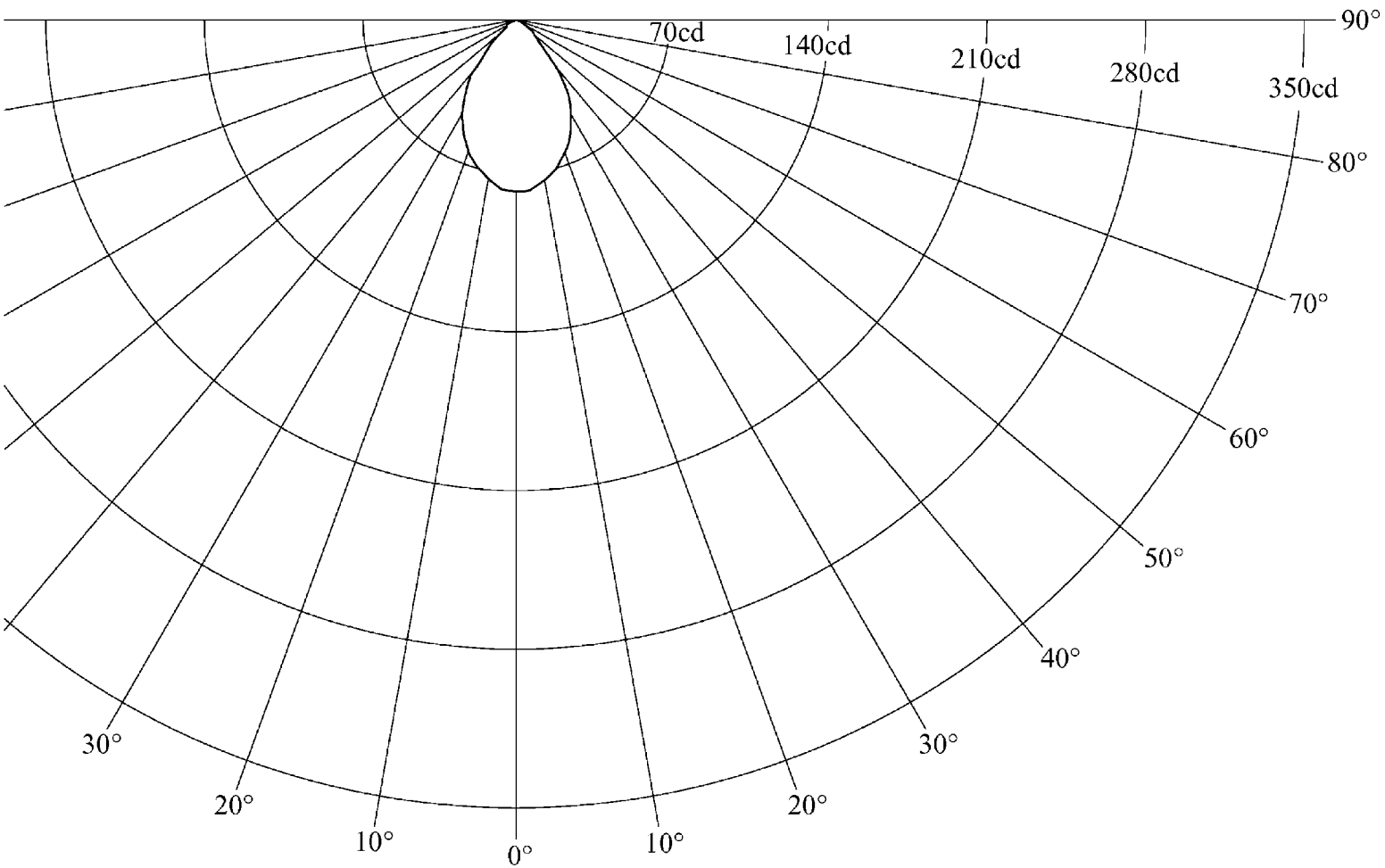
FIG. 7 shows a polar distribution in the vertical plane, scaled in candela, of a single LED with a Lambertian light distribution and without an orientable lens of the present invention in use.
Figure 8:
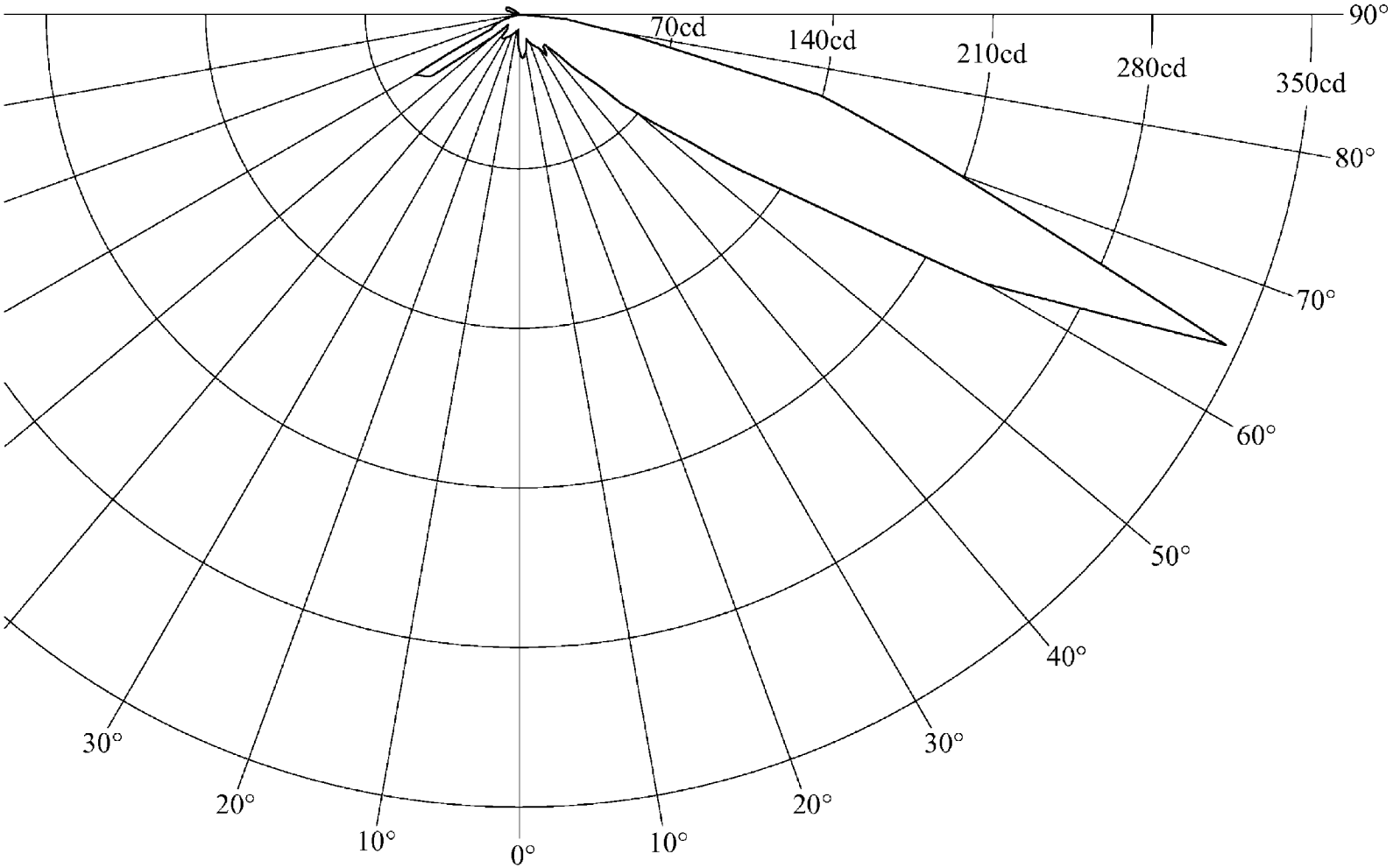
FIG. 8 shows a polar distribution in the vertical plane, scaled in candela, of the same LED of FIG. 7 with an embodiment of orientable lens of the present invention in use.
Figure 9:
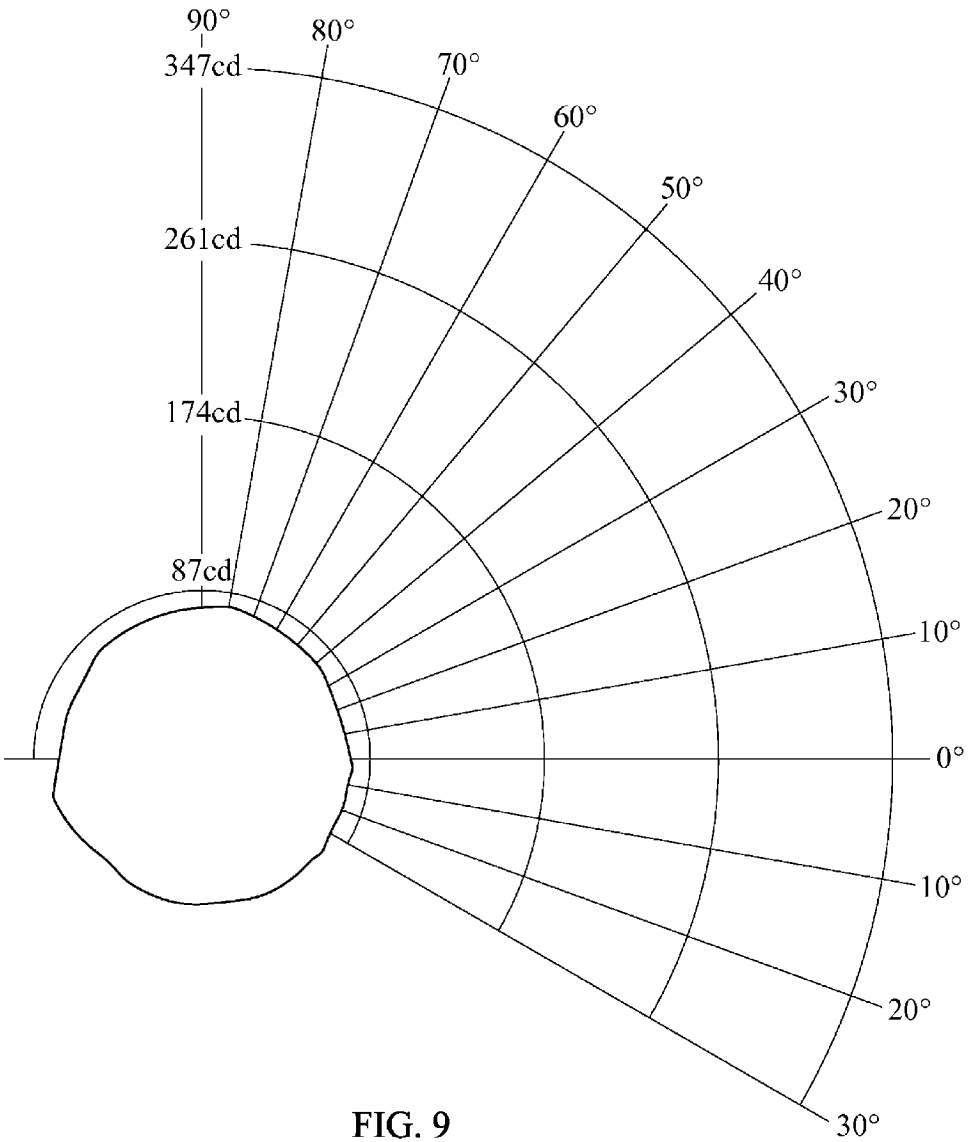
FIG. 9 shows a polar distribution in the horizontal plane, scaled in candela, of the same LED of FIG. 7 without an orientable lens of the present invention in use.
Figure 10:
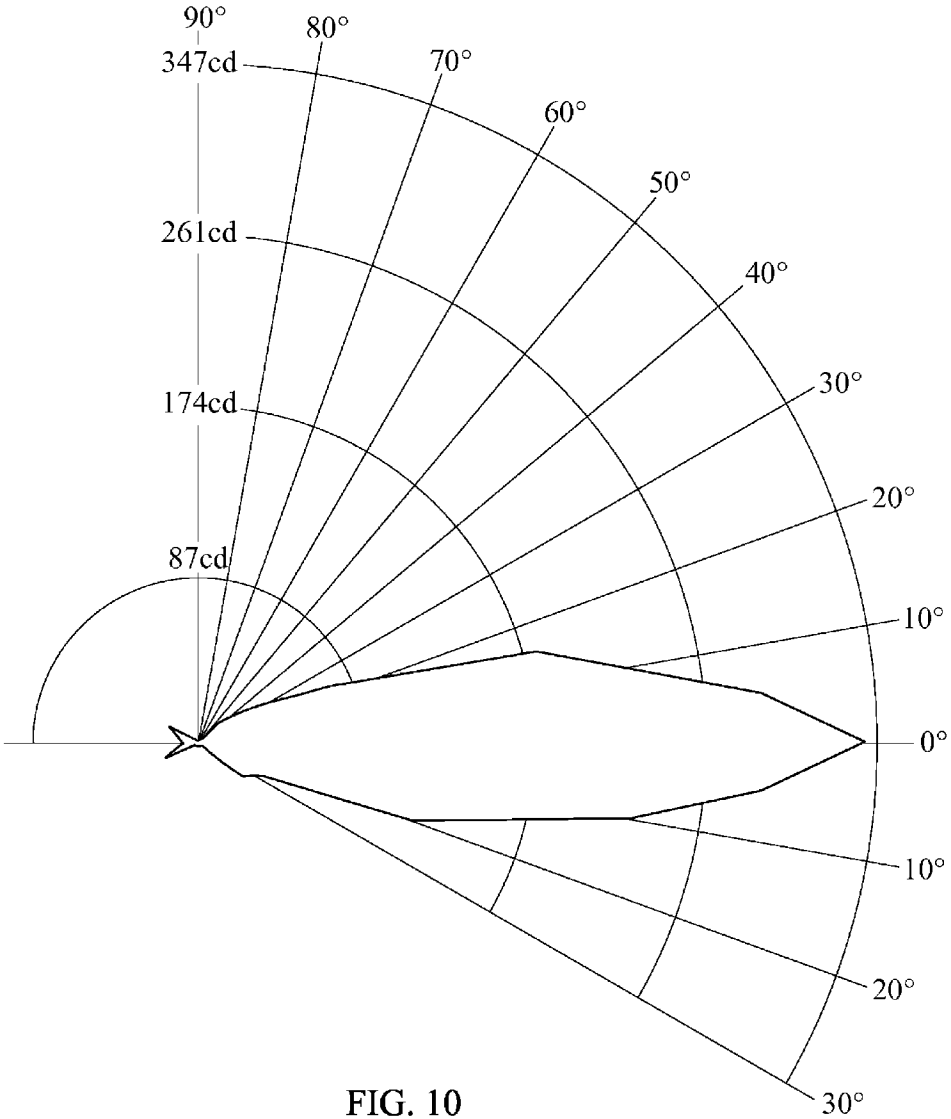
FIG. 10 shows a polar distribution in the horizontal plane, scaled in candela, of the same LED of FIG. 7 with the same orientable lens of FIG. 8 in use.

FIG. 7 shows a polar distribution in the vertical plane, scaled in candela, of a single LED with a Lambertian light distribution and without an orientable lens. FIG. 9 shows a polar distribution in the horizontal plane, scaled in candela, of the same led of FIG. 7. FIG. 8 shows a polar distribution in the vertical plane, scaled in candela, of the same LED of FIG. 7 with the embodiment of orientable lens showed in the figures in use. FIG. 10 shows a polar distribution in the horizontal plane, scaled in candela, of the same LED of FIG. 7 with the same orientable lens of FIG. 8 in use.

As can be seen from FIG. 8 and FIG. 10 orientable lens 10 directs a majority of light outputted by a LED with a Lambertian light distribution off a LED light output axis. In the vertical plane, shown in FIG. 8, a majority of the light is directed within a range from approximately 50° to 75° off the light output axis. In the horizontal plane, shown in FIG. 10, a majority of the light is directed within a 40° range away from the light output axis. Approximately 90% of light outputted by a LED with a Lambertian light distribution having the embodiment of orientable lens of FIG. 8 and FIG. 10 in use is distributed off the light output axis. FIG. 7-FIG. 10 are provided for purposes of illustration of an embodiment of orientable lens. Of course, other embodiments of orientable lens may be provided that produce differing polar distributions that direct light in a differing range off of and away from the light output axis. Thus, in the vertical plane of other embodiments light may be mainly directed in wider or narrower ranges and at a variety of angles away from the light output axis. In the horizontal plane of other embodiments light may likewise be directed in wider or narrower ranges.

Figure 11:
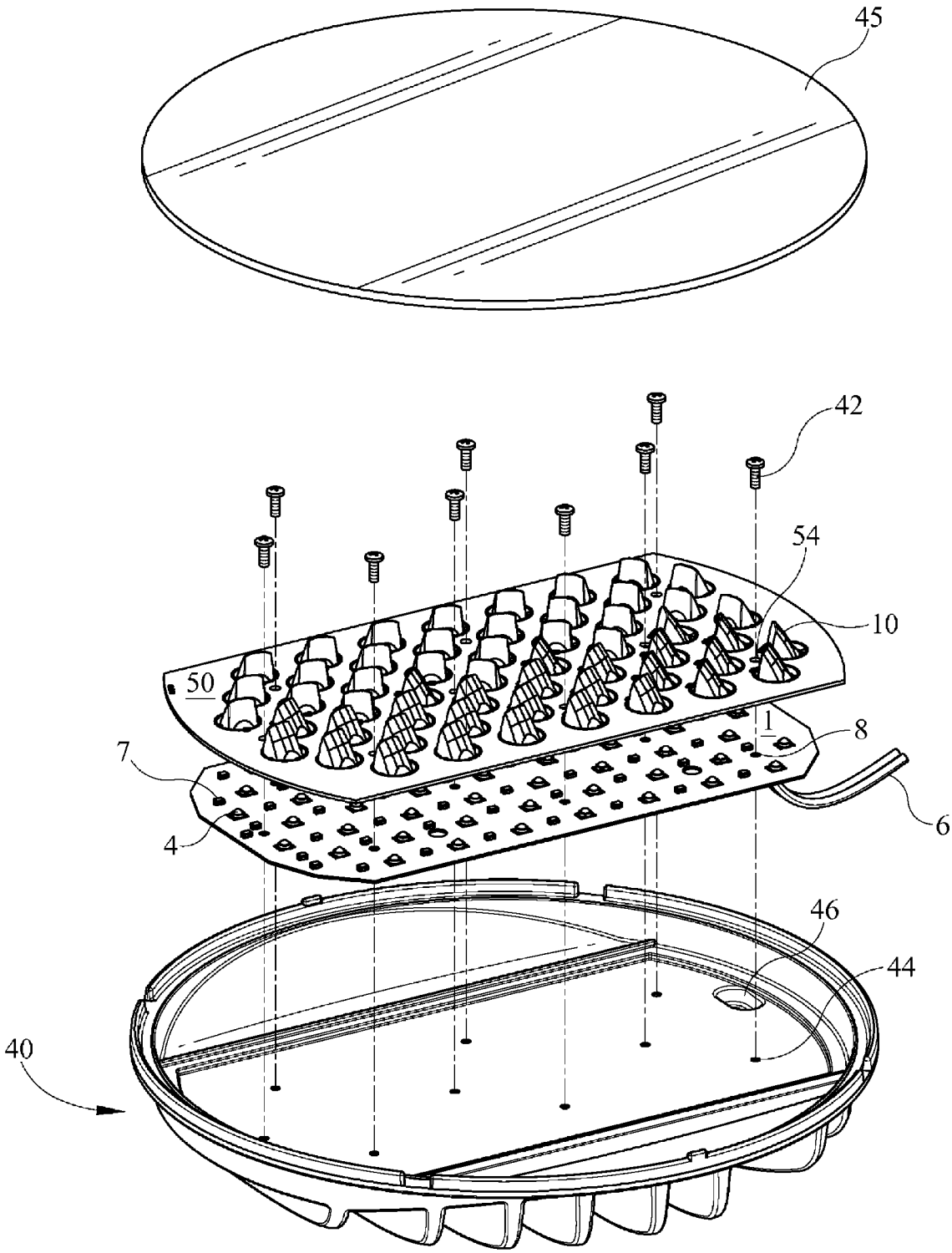
FIG. 11 is an exploded perspective view of an embodiment of a LED fixture with orientable lens shown with a flat board populated with a plurality of LEDs, a plurality of orientable lenses arranged in a positioning sheet, a heat sink, and a lens.

Referring to FIG. 11, an exploded perspective view of an embodiment of a LED fixture with a positioning sheet for orientable lenses is shown. Flat board 1 is populated with fifty-four LEDs 4 and has an electrical cable 6 for connecting flat board 1 to a power source. Flat board 1 is also populated with fifty-four Zener diodes 7 that are each electrically coupled with a LED 4 and allow current to bypass that LED 4 should it burn out. Fifty-four orientable lenses 10 are positioned along a positioning sheet 50 at various orientations. In some embodiments a portion of base 12 of each orientable lens 10 is affixed to an adhesive side of positioning sheet 50. In some embodiments of positioning sheet 50, positioning sheet 50 is a metallic board with advantageous heat distribution properties such as, but not limited to, aluminum. A lens 45 is also shown. In other embodiments of LED fixture with a positioning sheet for orientable lenses, differing amounts of LEDs 4, orientable lenses 10, and differing shapes and configurations of positioning sheet 50 and flat board 1 are provided.

When assembled, flat board 1 may be placed on heatsink 40 and alignment apertures 8 of flat board 1 aligned with threaded apertures 44 of heatsink 40. Positioning sheet 50 may then be placed adjacent flat board 1, causing base 12 of orientable lenses 10 to be sandwiched between positioning sheet 50 and flat board 1. Alignment apertures 54 of positioning sheet 50 may be aligned with alignment apertures 8 of flat board 1 and with threaded apertures 44 of heatsink 40. Nine threaded apertures 44 are placed in heatsink 40 and correspond in position to nine alignment apertures 54 of positioning sheet 50 and nine alignment apertures 8 of flat board 1. Electrical cable 6 may be placed through gasket 46 for attachment to a power source. Screws 42 may be inserted through alignment apertures 54 of positioning sheet 50 and apertures 8 of flat board 1 and received in threaded apertures 44 of heatsink 40. The head of screws 42 may contact positioning sheet 50 and screws 42 appropriately tightened to secure positioning sheet 50 and flat board 1 to heatsink 40 and to cause positioning sheet 50 to provide force against each base 12 of orientable lenses 10. This force causes each base 12 of orientable lenses 10 to be compressed between positioning sheet 50 and flat board 1 and causes each orientable lens 10 to be individually affixed about an LED 4 of flat board 1. Alignment apertures 54 and alignment apertures 8 are positioned so that when they are aligned each orientable lens 10 will be appropriately positioned about each LED 4. Lens 45 may then be coupled to heatsink 40.

Figure 12:
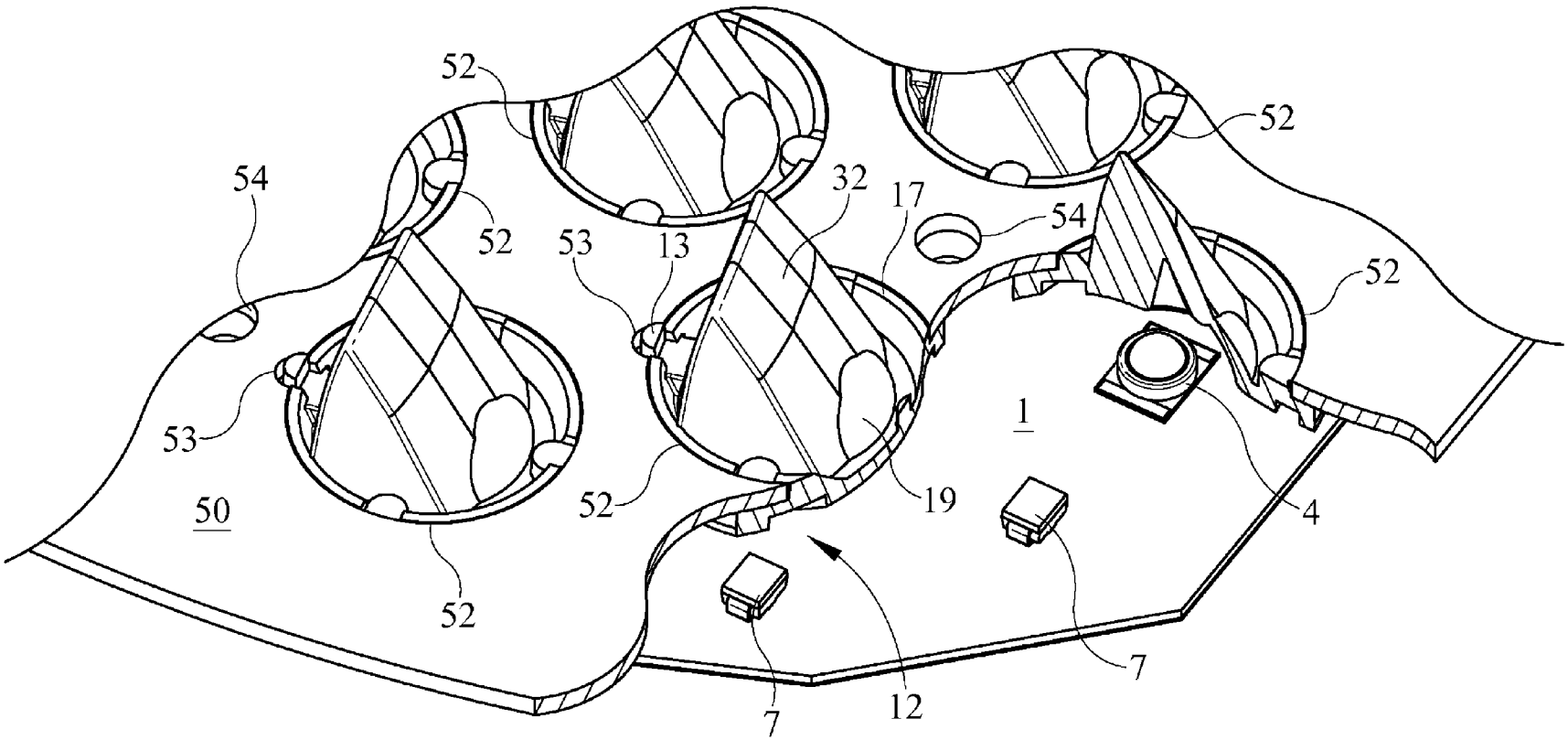
FIG. 12 is a perspective view of a portion of the flat board, positioning sheet, and orientable lenses of FIG. 11 with a portion of the positioning sheet and two orientable lenses cut away.
Figure 13:
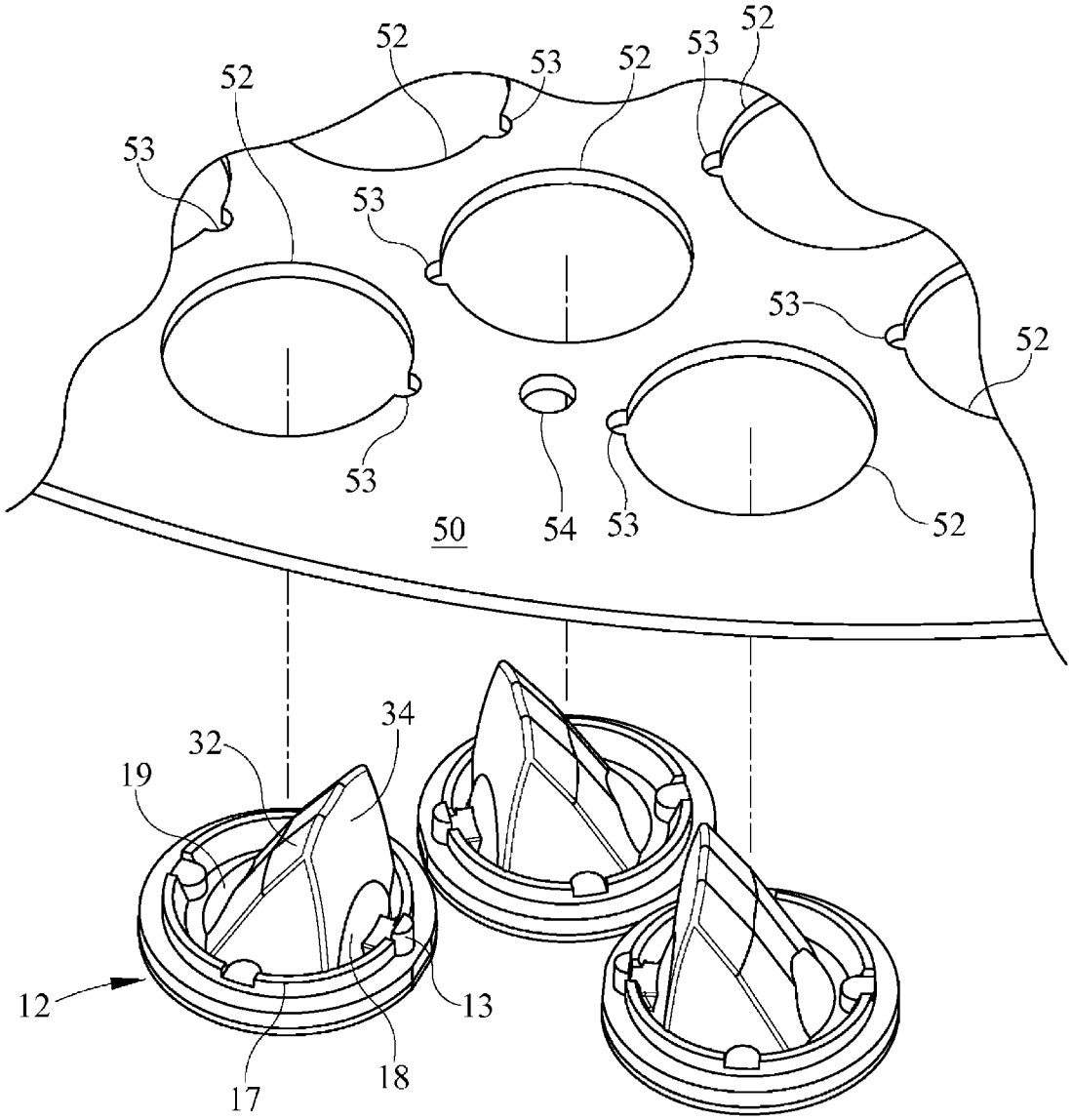
FIG. 13 is a perspective view of a portion of the positioning sheet and three orientable lenses of FIG. 11.

Referring to FIG. 12 and FIG. 13, the embodiment of positioning sheet 50 shown has a plurality of apertures 52 that each surrounds a portion one orientable lens 10. Only one orientable lens 10 is shown with reference numbers in each of FIG. 12 and FIG. 13 to simplify the Figures. In the depicted embodiments each aperture 52 has an alignment notch 53 that corresponds to an alignment structure having an alignment protrusion 13 that extends from base 12 of each orientable lens 10. Alignment notch 53 receives alignment protrusion 13 to ensure each orientable lens 10 is appropriately oriented about a corresponding LED to achieve a particular light distribution for the LED fixture. In the depicted embodiments, rim portion 17 of base 12 abuts the inner periphery of aperture 52 and also helps position each orientable lens 10 in aperture 52. In some embodiments the side of positioning sheet 50 that contacts the flange portion around rim portion 17 is adhesive and adheres to flange portion of base 12 surrounding rim portion 17. This may help maintain orientable lenses 10 in position while placing positioning sheet 50 adjacent flat board 1 so that a portion of each orientable lens 10 is compressed between positioning sheet 50 and flat board 1. Through use of positioning sheet 50, orientable lenses 10 may be individually oriented and accurately positioned with respect to a plurality of LEDs on a mounting surface.

Although positioning sheet 50 and its interaction with orientable lenses 10 is shown in detail in FIG. 11-13, it is merely exemplary of one embodiment of positioning sheet 50 and orientable lenses 10. There are a variety of different shapes, constructions, orientations, and dimensions of positioning sheet 50, flat board 1, and orientable lenses 10 that may be used as understood by those skilled in the art. For example, in some embodiments, some or all of apertures 52 of positioning sheet 50 may be provided with a plurality of alignment notches 53 that correspond with one or more alignment protrusions 13. This alignment structure would enable an orientable lens 10 to be placed in aperture 52 at any one of a plurality of orientations and enable a single positioning sheet 50 to be used to achieve various light distribution patterns. Also, for example, in some embodiments apertures 54 and orientable lenses 10 may be provided without alignment apertures and notches and each orientable lens 10 may be individually oriented within apertures 54 at a given orientation by a robotic type assembly. Also, for example, in some embodiments, apertures 52 may be provided with alignment protrusions that are received in corresponding alignment notches of orientable lenses 10. Also, for example, in some embodiments apertures 52 may be square, rectangular, or otherwise shaped and orientable lenses 10 could be configured to interact with such shapes. Also, for example, in some embodiments a single aperture 52 may be configured to surround and secure more than one orientable lens 10. Also, for example, in some embodiments rim portion 17 may not be present or may be square, rectangular, or otherwise shaped.

Moreover, there are a variety of ways positioning sheet 50 may be positioned and secured to provide force on orientable lenses 10 and cause each orientable lens 10 to be positioned about an LED and compressed between positioning sheet 50 and a mounting surface as understood by those skilled in the art. For example, flat board 1 may be provided with one or more protrusions extending perpendicularly from the LED mounting surface of flat board 1. The one or more protrusions could be received in one or more alignment apertures 54 of positioning sheet 50 to appropriately align each orientable lens 10 about an LED 4. Positioning sheet 50 could then be secured to heatsink 40 using screws or other securing device. Also, for example, positioning sheet 50 and flat board 1 may be secured adjacent one another and secured to heatsink 40 in a variety of ways. For example, positioning sheet 50 and flat board 1 may be secured adjacent one another using a plurality of securing clips and secured to heatsink 40 using screws that extend through heatsink 40 and are received in threaded apertures provided in flat board 1. Also, for example, adhesives may be used to secure positioning sheet 50, flat board 1, and/or heatsink 40 to one another. Moreover, positioning sheet 50 may be aligned with respect to flat board 1 in other ways than with alignment apertures 54 and alignment apertures 8 as understood by those skilled in the art. For example, they may be robotically aligned or may be aligned by lining up their peripheries with one another.

The foregoing description has been presented for purposes of illustration. It is not intended to be exhaustive or to limit the invention to the precise forms disclosed, and obviously many modifications and variations are possible in light of the above teaching. It is understood that while certain forms of the orientable lens for a led fixture have been illustrated and described, it is not limited thereto except insofar as such limitations are included in the following claims and allowable functional equivalents thereof.

I claim:

1. A lens placeable about a LED having a light emitting portion capable of emitting a light output, said lens comprising:

a reflector configured to surround a majority of said light emitting portion of said LED;

wherein said reflector comprises at least one primary reflector partially surrounding said LED and at least one secondary reflector partially surrounding said LED, said primary reflector having a first configuration and said secondary reflector having a second configuration distinct from said first configuration;

a refracting lens interior to at least a portion of said reflector and positioned to intersect some of said light output when said lens is individually placed about said LED;

an angled reflective surface, a majority of said angled reflective surface positioned more distal said LED than said reflector and said refracting lens when said lens is individually placed about said LED;

wherein said reflector is oriented to direct a majority of said light output incident thereon toward said angled reflective surface;

wherein said refracting lens is oriented to direct a majority of said light output incident thereon toward said angled reflective surface;

wherein said angled reflective surface is oriented to reflect a majority of said light output incident thereon in an off-axis direction; and wherein said lens is individually placeable about said LED.

2. The lens of claim 1, wherein said reflector is configured to completely surround said light emitting portion of said LED.

3. The lens of claim 2, wherein said reflector comprises at least one primary reflector portion having a first configuration and at least one secondary reflector portion having a second configuration distinct from said first configuration.

4. The lens of claim 1, wherein said primary reflector comprises a first and second primary reflector portion and said secondary reflector portion is interposed between said first primary reflector portion and said second primary reflector portion.

5. The lens of claim 1, wherein a majority of said light output incident on said angled reflective surface is directed therefrom within a 60° range in a horizontal plane.

6. The lens of claim 5, wherein a majority of said light output incident on said angled reflective surface is directed therefrom within a 60° range in a vertical plane.

7. The lens of claim 1, wherein said primary reflector comprises a parabolic reflector.

8. The lens of claim 1, wherein said reflective surface comprises at least a first reflective face at a first angular orientation and a second reflective face at a second angular orientation unique from said first angular orientation.

9. The lens of claim 1, further comprising a base coupled to and provided peripherally of said reflector.

10. The lens of claim 1, wherein said lens is configured to be in non-contact with said LED when placed thereabout.

11. A lens placeable about a LED having a light emitting portion capable of emitting a light output, said lens comprising:

a base configured to contact a surface provided peripherally of said LED and surround said LED;

a reflector configured to surround a majority of said light emitting portion of said LED, said reflector extending to a location that is more proximal to said surface than a topmost portion of said LED is to said surface, said topmost portion of said LED being the portion of said light emitting portion of said LED that is most distal from said surface;

a refracting lens at least partially surrounded by said reflector and positioned to intersect some of said light output;

a prism having a reflective surface, a majority of said reflective surface positioned more distal said base than said reflector and said refracting lens;

wherein said reflector is oriented to direct a majority of said light output incident thereon toward said reflective surface;

wherein said refracting lens is oriented to direct a majority of said light output incident thereon toward said reflective surface;

wherein said reflective surface is oriented to reflect a majority of said light output incident thereon through and out said prism in an off-axis direction; and wherein said base, said reflector, said refracting lens, and said prism are a cohesive integrally formed unit.

12. The lens of claim 11, wherein said reflecting prism of said lens is positioned and configured to reflect a majority of said light in a vertical plane within a range of 40° in said off-axis direction.

13. The lens of claim 11, wherein said lens is configured to direct at least 70% of said light emitted from each said LED in said off-axis direction.

14. The lens of claim 11, wherein the direction of a majority of said light output reflected by said reflective surface is altered prior to or simultaneous with exiting said prism.

15. The lens of claim 11, wherein said base includes at least one alignment structure thereon.

16. The lens of claim 11, wherein said reflective surface comprises at least a first reflective face at a first angular orientation and a second reflective face at a second angular orientation unique from said first angular orientation.

17. A lens placeable about a LED having a light emitting portion capable of emitting a light output, said lens comprising:

a base configured to contact a surface provided peripherally of said LED and surround said LED, said base having an alignment structure thereon;

wherein said alignment structure is configured for interaction with other non-lens structure to thereby orient said lens in a desired rotational orientation;

a reflector coupled to said base and configured to surround a majority of said light emitting portion of said LED;

a reflective surface coupled to said base, a majority of said reflective surface positioned more distal said base than said reflector;

wherein said reflector is oriented to direct a majority of said light output incident thereon toward said reflective surface; and wherein said reflective surface is oriented to reflect a majority of said light output incident thereon in an off-axis direction.

18. The lens of claim 17 further comprising a refracting lens positioned to intersect some of said light output.

19. The lens of claim 18 wherein said refracting lens is at least partially surrounded by said reflector.

20. The lens of claim 17 wherein said alignment structure comprises an alignment protrusion.

21. The lens of claim 20 wherein said alignment protrusion extends in a direction generally opposite said surface provided peripherally of said LED when said lens is affixed about said LED.

* * * * *